United States Patent [19]

Minnetti

[11] 4,374,471

[45] Feb. 22, 1983

[54] PLANT FOR TRANSFERRING YARN HANKS ALONG A PATH PASSING THROUGH A TREATING UNIT

[75] Inventor: Federico Minnetti, Pieve a Nievole, Italy

[73] Assignee: Officine Minnetti di Ornella Raveggi & C.S.a.s., Pieve a Nievole, Italy

[21] Appl. No.: 191,341

[22] Filed: Sep. 26, 1980

[51] Int. Cl.[3] ..... D06B 15/02

[52] U.S. Cl. ..... 68/245; 68/265; 198/473; 198/681

[58] Field of Search ..... 68/22 R, 245, 265; 100/121, 173; 198/473, 681; 28/287, 288

[56] References Cited

U.S. PATENT DOCUMENTS

| | | | |
|---|---|---|---|
| 610,781 | 9/1898 | Whiteley | 198/473 |
| 1,861,600 | 6/1932 | Harrison | 198/473 |
| 2,965,214 | 12/1960 | Schlumpf et al. | 198/473 |
| 3,472,354 | 10/1969 | Locatelli | 198/473 |

FOREIGN PATENT DOCUMENTS

| | | | |
|---|---|---|---|
| 1517661 | 2/1968 | France . | |
| 2137917 | 12/1972 | France . | |
| 38-3984 | 4/1963 | Japan | 68/22 R |
| 45-41625 | 12/1970 | Japan | 68/22 R |
| 129532 | 7/1919 | United Kingdom . | |
| 678252 | 8/1952 | United Kingdom . | |
| 1024629 | 3/1966 | United Kingdom . | |

*Primary Examiner*—Philip R. Coe
*Attorney, Agent, or Firm*—Fleit & Jacobson

[57] ABSTRACT

A plant for automatically supplying hanks carried on sticks to a squeezing unit or squeezer for hank squeezing, for removing squeezed hanks from the squeezer, for transfer of hanks to a movement line or apparatus and for stick removal. The plant has a chain feeder for the squeezer, a roller squeezer with stick gripping pliers, a chain unloading conveyor and a pliers transferring apparatus or translating device, and is adjustable for adaptation to sticks of various lengths.

18 Claims, 20 Drawing Figures

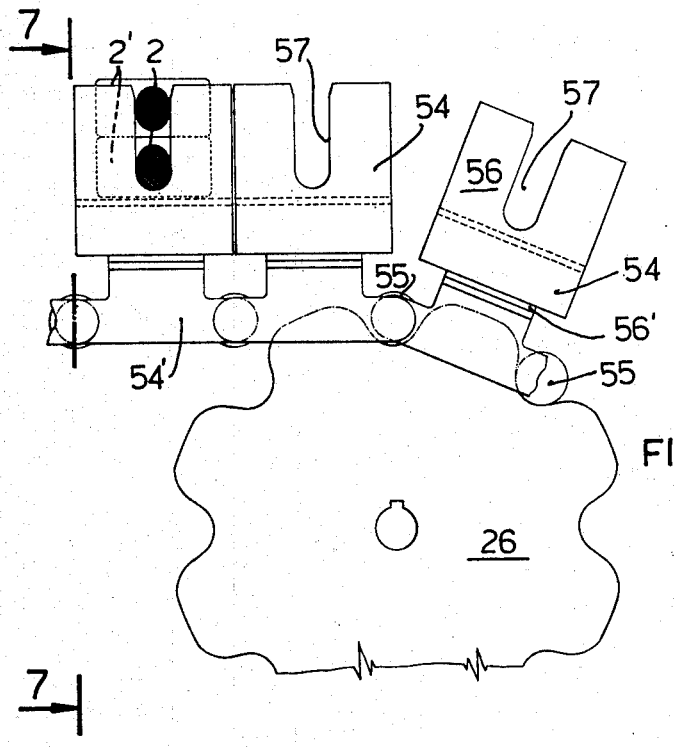
FIG.6
FIG.20
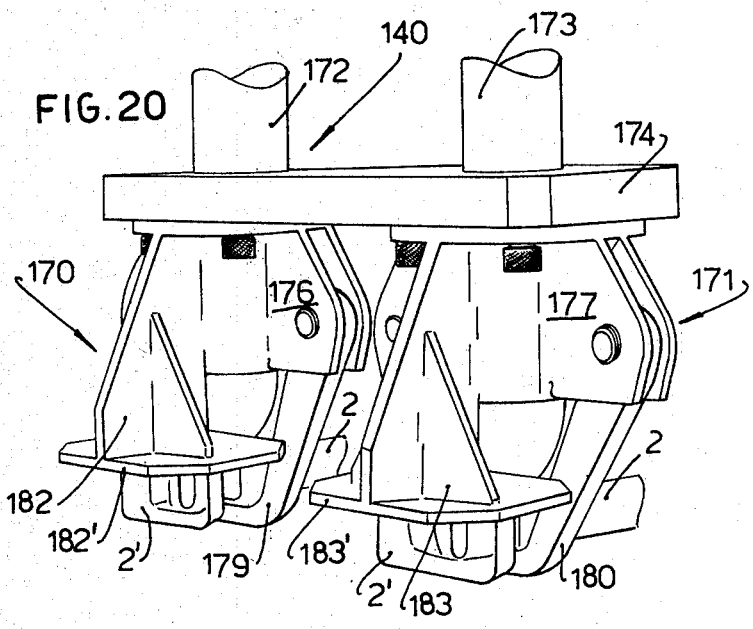

FIG.7
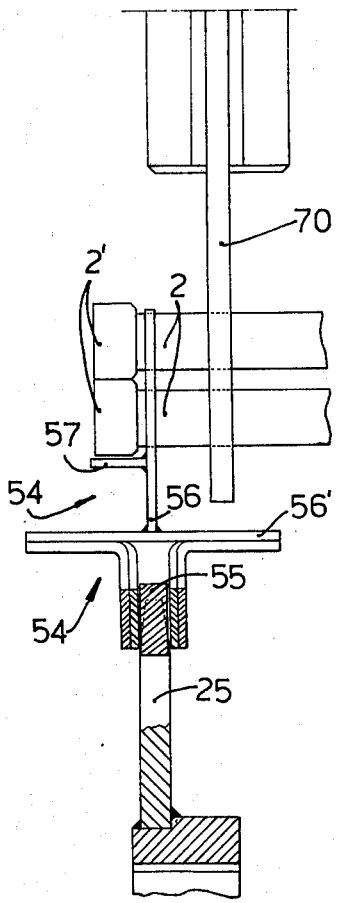
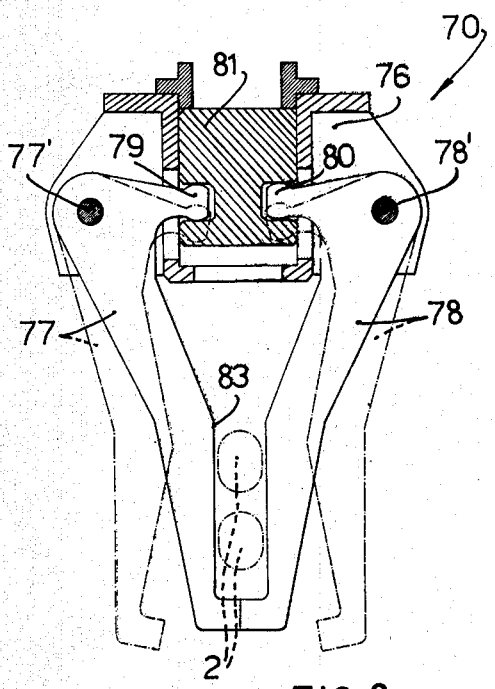
FIG.8

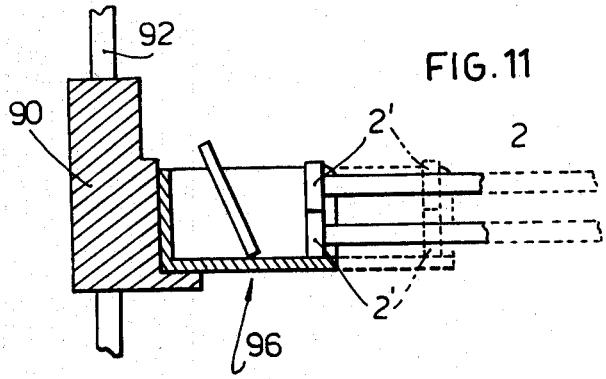
FIG. 11
FIG. 12
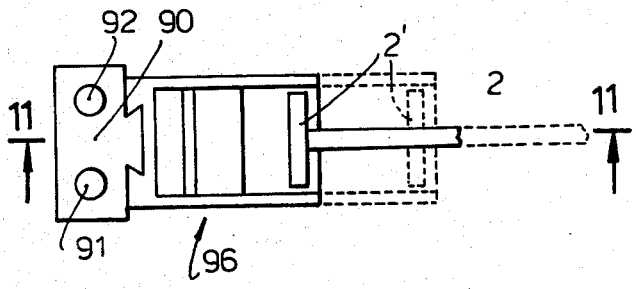
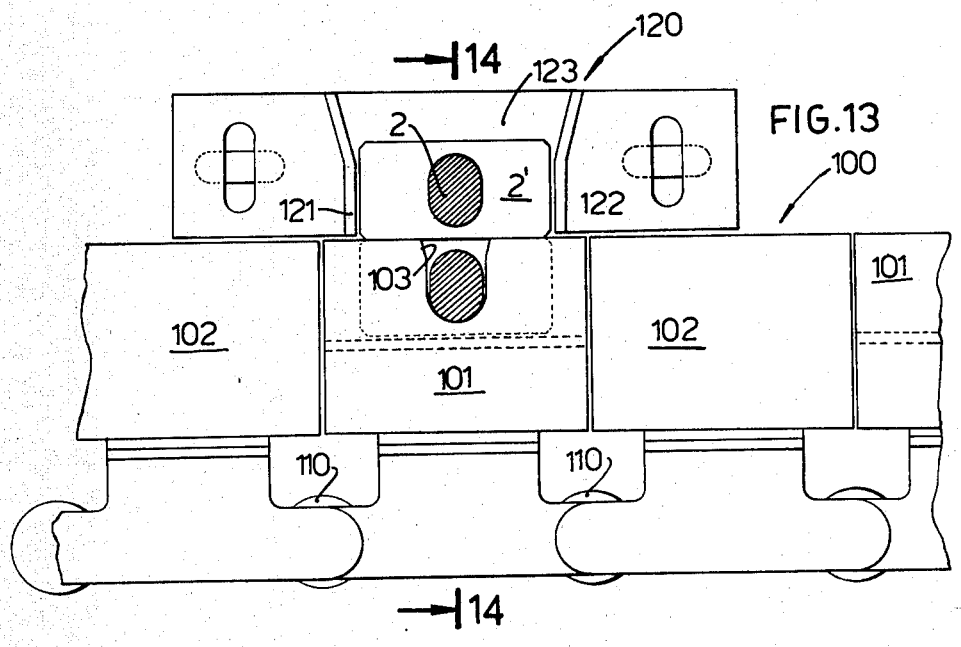
FIG. 13

PLANT FOR TRANSFERRING YARN HANKS ALONG A PATH PASSING THROUGH A TREATING UNIT

The invention relates to a system or plant for the removal of liquid from skein or hank yarns, wherein the skeins or hanks are carried on sticks, and it also relates to a process for such a plant.

In at present existing textile plants, the yarn hanks that have been subjected to a treatment, in which they have been wetted to some extent, such as for example dyeing, are arranged in cabinets (dyeing cabinets) or transport trucks, and are carried and stretched between two sticks inserted therein. In order to supply such hanks to further treatments, at present the common practice is to manually take each pair of sticks from the dyeing cabinet or truck, then removing one stick of said pair and placing the other stick with the suspended hanks on a supply chute of a squeezing device. Therefrom, a pair of pliers of the squeezer grip each stick (with the suspended hanks), moving and locating it with the ends in supporting cups on a pair of slides of the squeezer, which provide for lowering the stick along with the hanks in the space or gap between a pair of spaced apart squeezing rollers, of which one is a driven roller and the other is an idle roller; then the squeezing rollers are moved near each other and the hanks therebetween are lifted (which causes the wringing or squeezing thereof) and then moved with the stick on an unloading chute by means of a further pair of pliers. Therefrom, the hanks are still manually gripped, withdrawn from the stick and generally inserted on the skein holder or hank carrier supports of a supply chain in a drier.

Such known plants, as above shortly summarized, involve the supervision of at least two operators and accordingly relatively high costs; moreover, the work is hard and the repeated manual handlings of the hanks would generally involve yarn tangles which, in turn, cause an extension in time required for the successive winding off or unwinding. Another disadvantage resides in that a hank yarn treating plants use is at present made of sticks of various lengths; and hitherto the conveyors and squeezers had to be made of different dimensions according to the size of stick used in each plant.

Therefore, the aim was proposed of mechanizing as far as possible the squeezing and transfer operations for the hanks. The aim was also proposed of providing a universal type of squeezing system or plant suitable to any existing system for water removal from yarns operating with sticks of preset length.

This has been accomplished by the system according to the present invention.

The plant essentially comprises a squeezer or chain supply device for supplying hank yarns to a squeezer for squeezing the hank yarns; a roller squeezer; an unloading conveyor or device for removing squeezed yarns from the squeezer; and a hank transfer and stick removal unit for removing and for transferring the yarns from the unloading device.

The squeezer supply device comprises a chain conveyor, in which two spaced apart chains stepwise intermittently move parallel to each other; both of the chains are made with plates provided with notches or cutouts of such depth and width that two sticks at overlapped relationship can be received; between the chains there being a free space sufficient to accomodate the hanks hanging down from the sticks.

As usual, a squeezing device comprises at least one pair, but preferably two pairs of stick gripping pliers (of which one pair of inlet pliers and one pair of outlet pliers); the inlet pliers take up the sticks as coupled by the feeder and place the stick ends in cups carried on a pair of vertically movable slides of the squeezer to lower the hanks between squeezing rollers, of which one is generally a driven roller and the other is an idle roller. The outlet pliers withdraw the sticks from the cups, placing them on the unloading conveyor. According to a feature of this invention, the pliers jaws and cups are of a configuration and size for receiving two sticks at parallel overlapped relationship; according to a further feature of this invention, the operation is given to the driven roller by a free-wheel device in order to avoid the "blow" between the squeezing rollers when the hank is removed from the space therebetween.

The squeezer unloading conveyor comprises a chain conveyor, wherein two chains are sufficiently spaced apart from each other that the hanks hang therebetween and parallel intermittently move; peculiarly, each chain alternately has a plate with a notch or cutout of sufficient area to receive only one stick and one or more plates free of notches or cutouts. Such a chain conveyor cooperates with a guiding and clearing device downstream of the squeezer outlet pliers to move the two coupled sticks of each hank group away from each other, so as to support the hanks kept at spread apart condition by the pair of spaced apart sticks.

A plant according to the invention also comprises a pliers transfer device apt to withdraw by two pairs of pliers the two spread apart sticks carrying the hanks for raising thereof from the unloading chains and withdrawal thereof by another apparatus, such as a spreadable rod apparatus for yarn transfer; examples of such apparatuses are disclosed in various copending applications of the same applicant.

According to a further significant feature of this invention, the whole system is so implemented as to be readily adapted to any stick size. In the present plant the capability of adaptation to the stick lengths is achieved by mounting the members designed to engage the stick ends (that is, the chains for the chain conveyors; the hook supports for the squeezer and the transfer device) on frames carried on sliding bars transversely of the yarn hank travel, and by arranging known adjusting means such as, for example, screw and female thread assemblies controlled by a handwheel or other known means.

The advantages achieved by this invention essentially consist of a reduction in personnel for operations with resulting lower operating costs; in a reduction of yarn entangling with resulting lower winding off costs, and in a high flexibility of the plant.

By mere way of unrestrictive example, a description will now be given of the process and of an exemplary embodiment of the plant according to this invention with reference to the accompanying drawings, in which:

FIG. 6 is an axial sectional view showing on enlarged scale a detail of the chain feeder with two inserted sticks;

FIG. 7 is fragmentary partly section view taken along arrow 7 in FIG. 6, also showing a squeezer hook at stick gripping position;

FIG. 8 is a cutaway and partly sectional view along pliers of the squeezer, the pliers being shown at opening and closing positions;

FIGS. 11 and 12 are a vertical sectional view taken along line 11—11 of FIG. 2 and a plan view, respectively, of the supporting cups for the stick ends, the cups being interchangeable on the squeezer slides;

FIG. 13 is a fragmentary elevational view along a chain of the unloading conveyor at the zone where fixed guides for the sticks are provided, which sticks are shown in sectional view;

FIG. 20 is a perspective view of the pair of stick retaining pliers in the transfer device.

Figure 1:
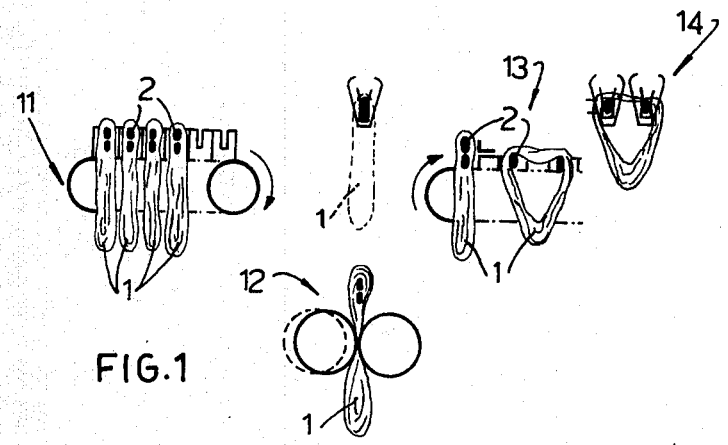
FIG. 1 is a diagrammatic elevational view of the parts comprising the plants, showing the various sequential steps in transferring and squeezing a hank or hank series.
Figure 2:
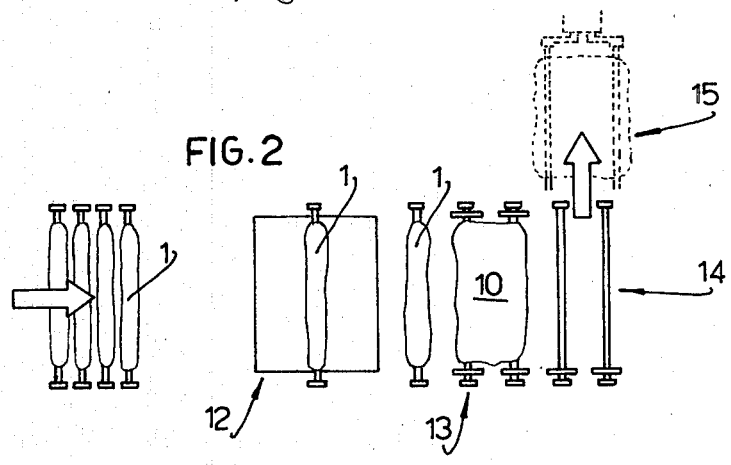
FIG. 2 is a diagrammatic top plan view relative to FIG. 1.
Figure 4:
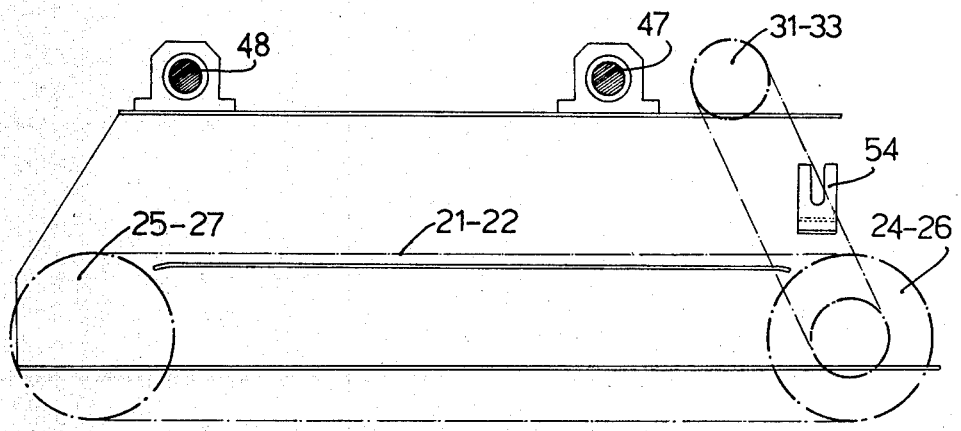
FIG. 4 is a fragmentary schematic illustration of the chain feeder shown in axial sectional view.

Referring to FIGS. 1 and 2 of the accompanying drawings, a brief explanation will now be given of the novel process and plant allowing the automatic movement of yarn hanks (shown at 1) on sticks (shown at 2), a squeezing operation and still automatically supply of the hanks to any known further transport means. In such figures of the accompanying drawings, reference numeral 11 denotes a supply conveyor or feeder, 12 the squeezer unit, 13 an unloading conveyor for the squeezer and 14 a hank transfer device. The arrows show the movement direction for the hanks. The device shown at 15 of FIG. 2 may be any rectilinearly movable or rotating spreadable rod hank transfer device; suitable devices are the subject of various copending applications of the same applicant.

A plant as above outlined is intended to be mounted downstream of a yarn dyeing plant, or other plant, after which the removal of liquid from the hank yarns is required. In such dyeing cabinets as those at present used, the hanks are carried at extended or stretched condition between two sticks 2 inserted therein. While upon (manual) extraction of the hanks from the cabinet, the hitherto common practice was that of immediately removing one of said two sticks 2, the novel process of the invention eliminates the operation of removing one of the two sticks, but provides that said two sticks 2 are moved near each other and concurrently support said hank 1 throughout the squeezing step, then providing at the outlet from the squeezing zone for use of the two sticks to widen or spread out said hanks to a sufficient extent to allow for the insertion of supporting rods for hank withdrawal.

The various parts of the system will now be further described.

In a novel system according to the present invention, the supply device for the squeezer unit 12 is a chain device, as shown in FIGS. 3, 4, 5, 6 and 7. Such a device comprises two chains 21 and 22 (which for the sake of simplicity are outlined by dash-dot line in FIGS. 4 and 5) extending along parallel paths, each of which between two respective gear wheels 24 and 25 for chain 21 and 26 and 27 for chain 22. Gear wheels 24 and 26 perform a driving function for the respective chains. Actually, only one of said two gear wheels 24 or 26 is intermittently driven from any type of drive unit (not shown), preferably through a free-wheel device (not shown, as well known to those skilled in the art).

The connection between said two gear wheels 24 and 26 is provided by an intermediate shaft 32 carrying at the ends gear wheels 31 and 33 for the connection with further gear wheels 29 and 34, of which gear wheel 34 is integral with shaft 35 of gear wheel 26, and gear wheel 29 is integral with shaft 28 of gear wheel 24.

It will be seen that said intermediate shaft is over and out of the chain path in order not to interfere with the hanks being conveyed.

Along with the respective shafts 28, 36, 35 and 37, the gear wheels 24, 25, 26 and 27 of the chains are mounted within bearings 38 integral with movable bars 40 and 41. Through bushing supports 42, 43, 44 and respectively 45, the latter are carried and can slide on a pair of guides 47 and 48 which are transversely arranged of the chains. At the ends, these guides 47 and 48 are carried on upstanding frames 49 and 50, on which said intermediate shaft 32 is also rotatably mounted. The displacement of said bars 40 and 41 on the guides is provided by any suitable means such as, for example, by a screw and female thread device shown at 51 and 52. A position at which said gear wheels 24, 25, 26 and 27 are shown near one another is shown by hatching on FIG. 5.

According to an important feature of the present invention, the above mentioned chains 21 and 22 comprise, as shown on FIGS. 6 and 7, plate elements 54 which are secured on chain elements 54', the latter being hinge interconnected by a intervening roller 55. Substantially, each of such plate elements comprises a plate 56 welded on a base 56' of any shape and provided with a notch or cutout 57 of sufficient dimensions to accomodate two sticks 2 at overlapped position, as shown in FIGS. 6 and 7. These notches or cutouts 57 are narrower than the stick heads 2', thereby being allowed to slide out of the respective plate. A metal strap 58 transversely extended from plate 56 may be provided for possible bearing of said heads.

The roller squeezer unit shown in FIG. 3 (partly schematically in this figure) and in FIGS. 8, 9, 10, 11 and 12 will now be described.

Figure 9:
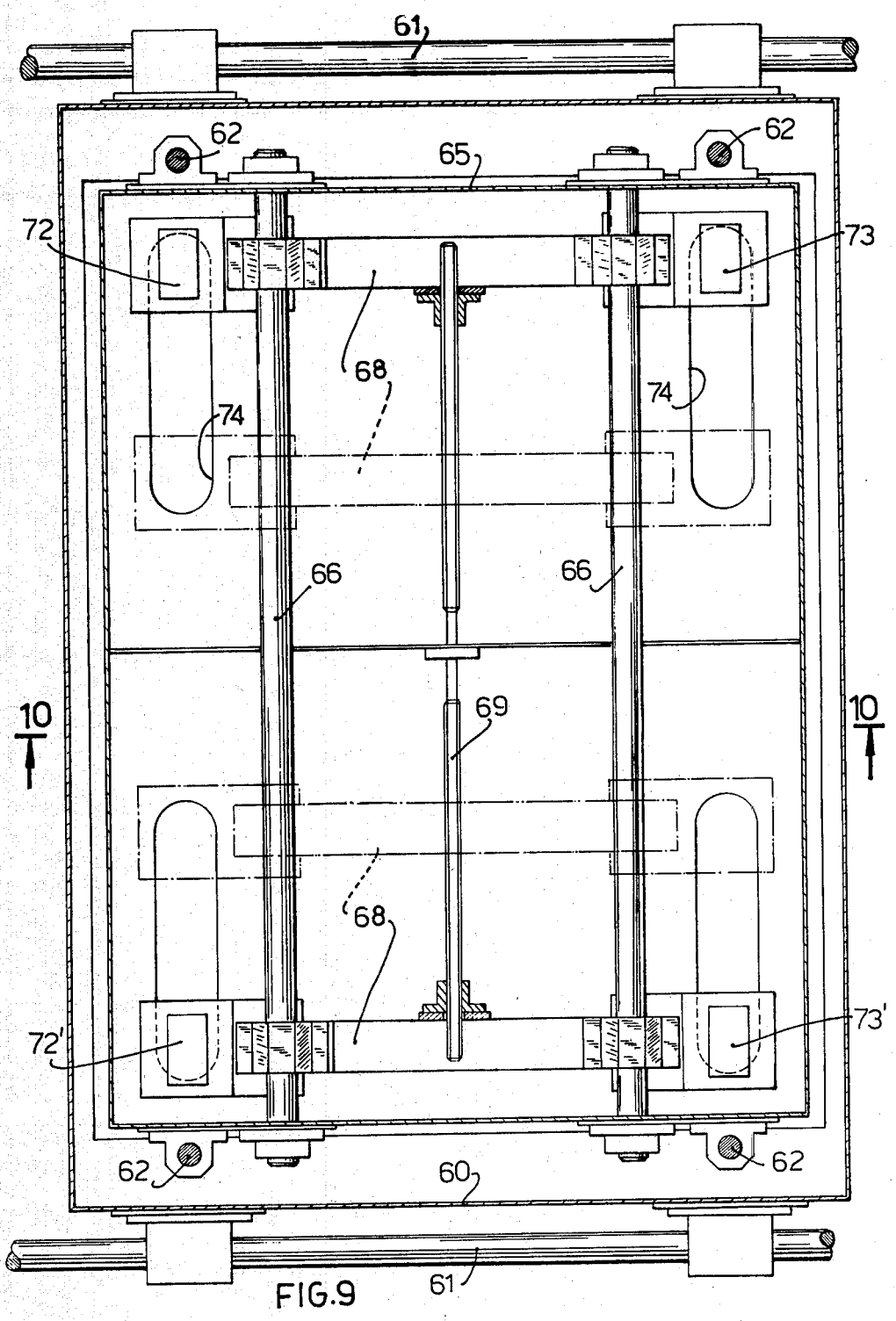
FIG. 9 is a plan head view of the squeezer unit.
Figure 10:
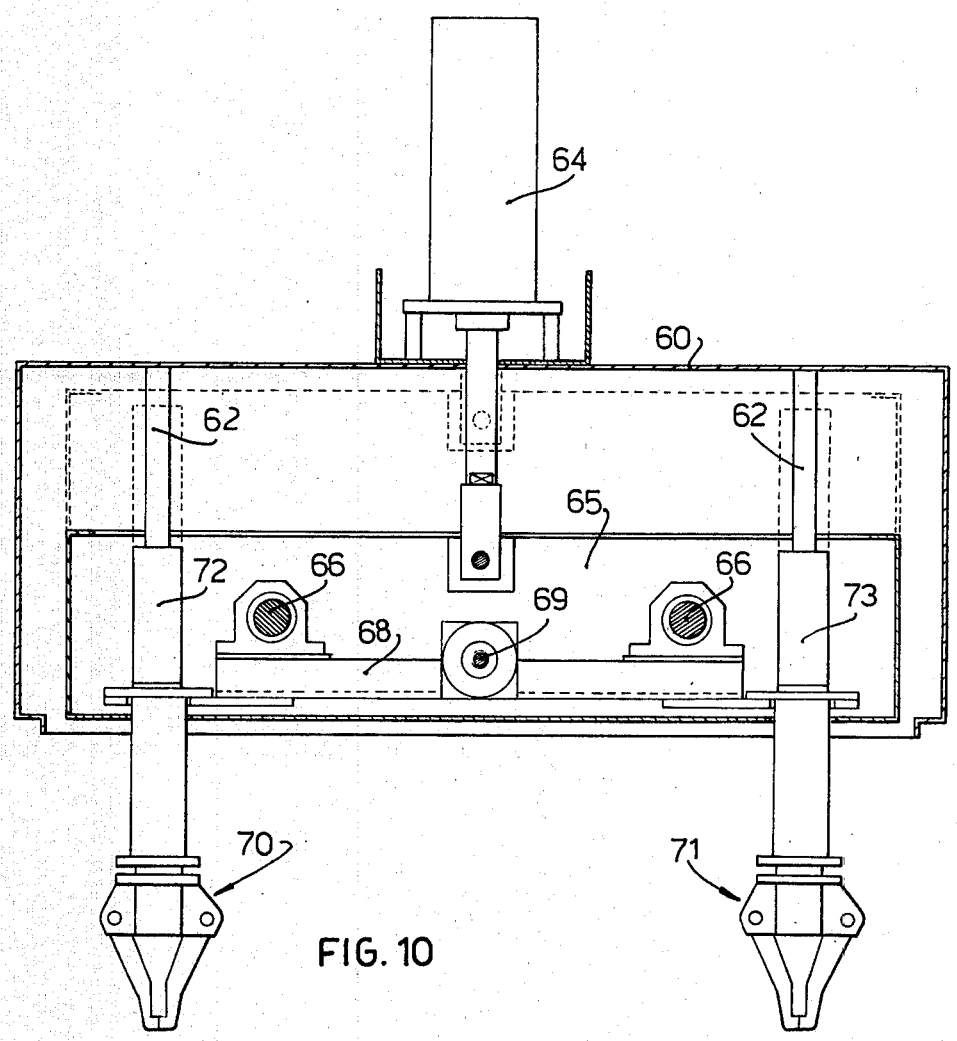
FIG. 10 is a sectional view according to line 10—10 of FIG. 9, taken along the head of the squeezer unit.
Figure 14:
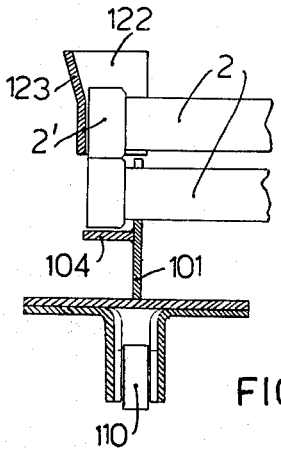
FIG. 14 is a sectional view taken along line 14—14 of FIG. 13.
Figure 15:
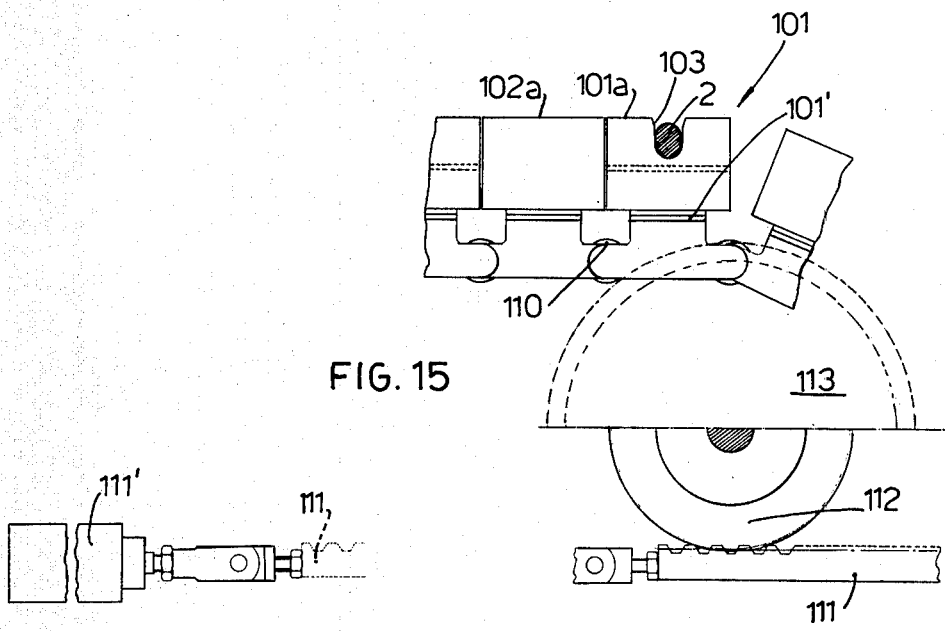
FIG. 15 is a fragmentary partly schematic view of the unloading conveyor control according to line 15—15 of FIG. 16.

This squeezer unit conventionally comprises a pliers holding frame 60 which is horizontally movable along sliding guides 61 by means, for example, of a cylinder-piston assembly 61'. Such a frame 60 carriers four vertical sliding rods 62, through which a carriage 65 can be lifted and lowered by a cylinder-piston assembly 64, and this carriage 65 has horizontal sliding rods (shown on FIG. 9) 66, 66 transverse of guides 61. For the adjustment of the distance or spacing therebetween, two pliers holding heads 68, 68 can slide on the above mentioned horizontal sliding rods 66, 66, the approaching or removing movement for these heads 68, 68 being controlled by a worm screw device or assembly 69. In FIG. 9 such heads are shown by full line at a position of maximum removal and by dash-dot line at an approached position. At positions corresponding to the other head, each head carries two pliers and relative control cylinder-piston units or assemblies. In FIG. 10 there are shown only one head 68, the relative pliers indicated at 70 and 71, and the control cylinder-piston units 72 and 73 therefor. Each of the pliers downwardly extend and upon adjustment of the distance or spacing are movable within a corresponding slot 74 provided in said box-like carriage 65. Each of the pliers, for example pliers 70 of FIG. 8, comprises a body 76, having a pair of jaws 77, 78 pivoted thereon at 77' and 78', respectively. Jaws noses or ends, respectively denoted by 79 and 80, are received in respective recesses or cavities in a slider 81 sliding in the body upon control of the respective cylinder-piston assembly or unit 72. The movement of said slider 81 relative to body 76 causes the opening and closing of the jaws. In FIG. 8 said jaws 77 and 78 are shown by full line at closed or approached position and by dashed line at removed or open position. Such jaws are of a particular shape with an elongated portion forming a cavity or recess 83 for receiving two overlapped sticks 2, 2.

From the foregoing it should be apparent that, once the spacing or distance between the heads has been adjusted, the pliers can be moved as a unitary assembly in horizontal sliding direction, and can be lifted and lowered. Among the four pliers, the two pliers closer to the feeder comprise the inlet pair, and the two pliers closer to the unloading device comprise the outlet pair.

Figure 3:
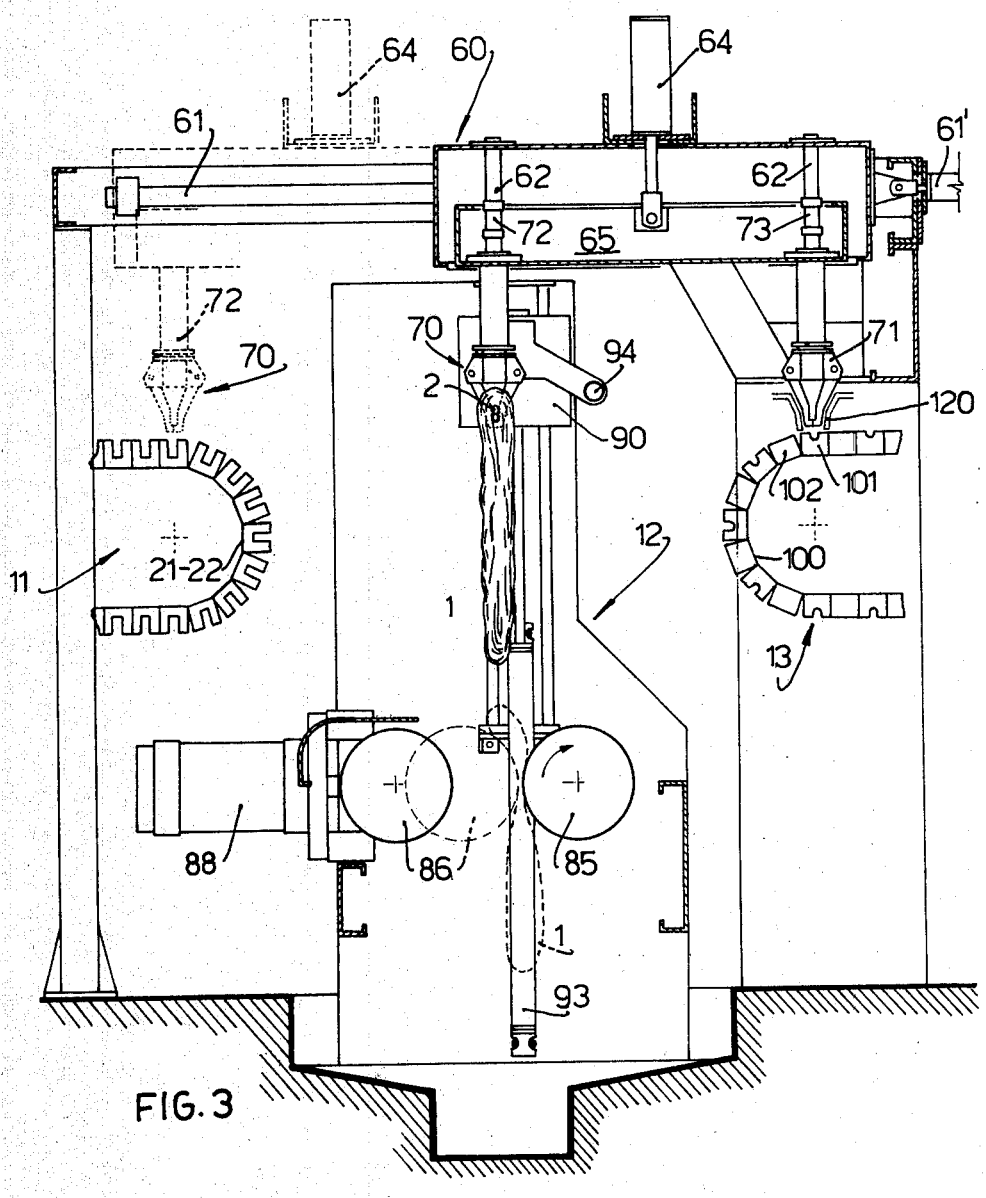
FIG. 3 is a partly schematic and partly sectional elevational view of the squeezer unit, with a partly shown chain feeder and a partly shown chain unloading device.
Figure 5:
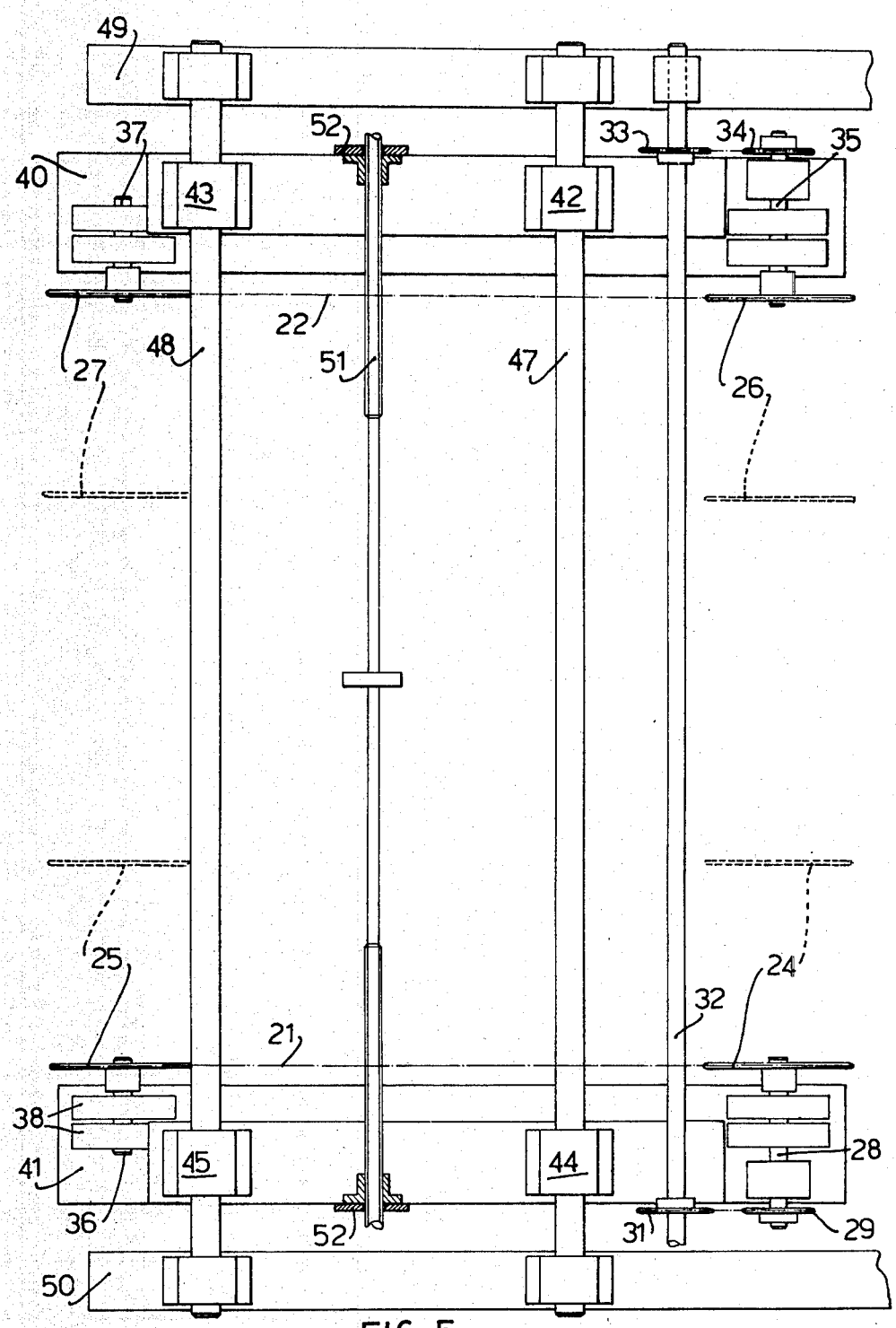
FIG. 5 is a partly schematic plan view of the chain feeder.

As conventional, the squeezer unit (FIG. 3) comprises a squeezing roller 85 at fixed position, which roller rotates in the direction as shown by the arrow, and an idle squeezing roller 86, movable between the position shown by full line in FIG. 3 and that shown by dashed line, under the control of the cylinder-piston unit or assembly 88. According to a preferred feature of the present invention, the movement to roller 85 is given by any type of free-wheel device in order to avoid any impact between the rollers, due to the difference in peripheral speed between said rollers, when the hank is extracted or removed.

The lowering of a hank between said rollers 85 and 86 is conventionally provided by a pair of opposite slides 90 (of which only one is shown in FIG. 3), which slides are provided with supports or bearing cups for the ends of sticks 2. As controlled by a cylinder-piston unit or assembly 93, each of said slides are vertically slidable along guides 91 and 92. For simultaneous operation, said two slides 90 are interconnected by a connection 94.

According to a preferred feature of the present invention, the supports or cups (such as, for example, cup 96 shown in FIGS. 11 and 12 on enlarged scale relative to FIG. 3) are of a sufficient size to receive the overlapped heads of two sticks 2, while cups of different dimensions (as shown by full line and dashed line in FIGS. 11 and 12) are provided as interchangeable on said slides 90 for adaptation to sticks of different lengths.

While the operation of the squeezer unit will be described in the following, the chain unloading device 13 for removing the squeezed hanks from the squeezer will now be described. The unloading device is particularly shown in FIGS. 3, 13, 14, 15 and 16.

An unloading device comprises two timingly movable, parallel chain members. Such members are carried on bars (like bars 40 and 41 for the feeder) movable on transverse guides so as to be moved near and away from each other for adaptation to various lengths of the sticks. Up to this point, the assembling is similar to that of the chain feeder, and accordingly has not been shown on the drawings and will not be described in detail. Instead, the different features will be described. Each of the unloading device chains, which for example will be denoted by 100, comprise plate elements secured on chain elements which are hinged to one another by small rollers 110. These plate elements are generally of two types denoted, for example, at 101 and 102. Element 101 has an upstanding plate welded on a base 101' with a recess or cavity 103 for receiving only one stick 2 (in FIG. 15 the stick is shown cutaway in the recess or cavity). Preferably, but not necessarily, this element 101, which is also shown in the upper half of FIG. 16, has a metal strap 104, projecting and underlying the stick head. The element 102, which is also shown in the lower half of FIG. 16, does not have a recess or cavity and has a continuous surface **102*a* at the same level as the upper surface 101*a* of element 101. Preferably, such a continuous surface has a bentover edge 106**.

The above mentioned chains 100 comprise elements 101 and 102. Generally, said elements 101 and 102 are alternated, that is to say that one element 101 is followed by one element 102 but, depending on the width to be given to the spread apart hanks, one element 101 and two or more elements 102 can be arranged; however, said elements 102 could be also omitted.

Figure 16:
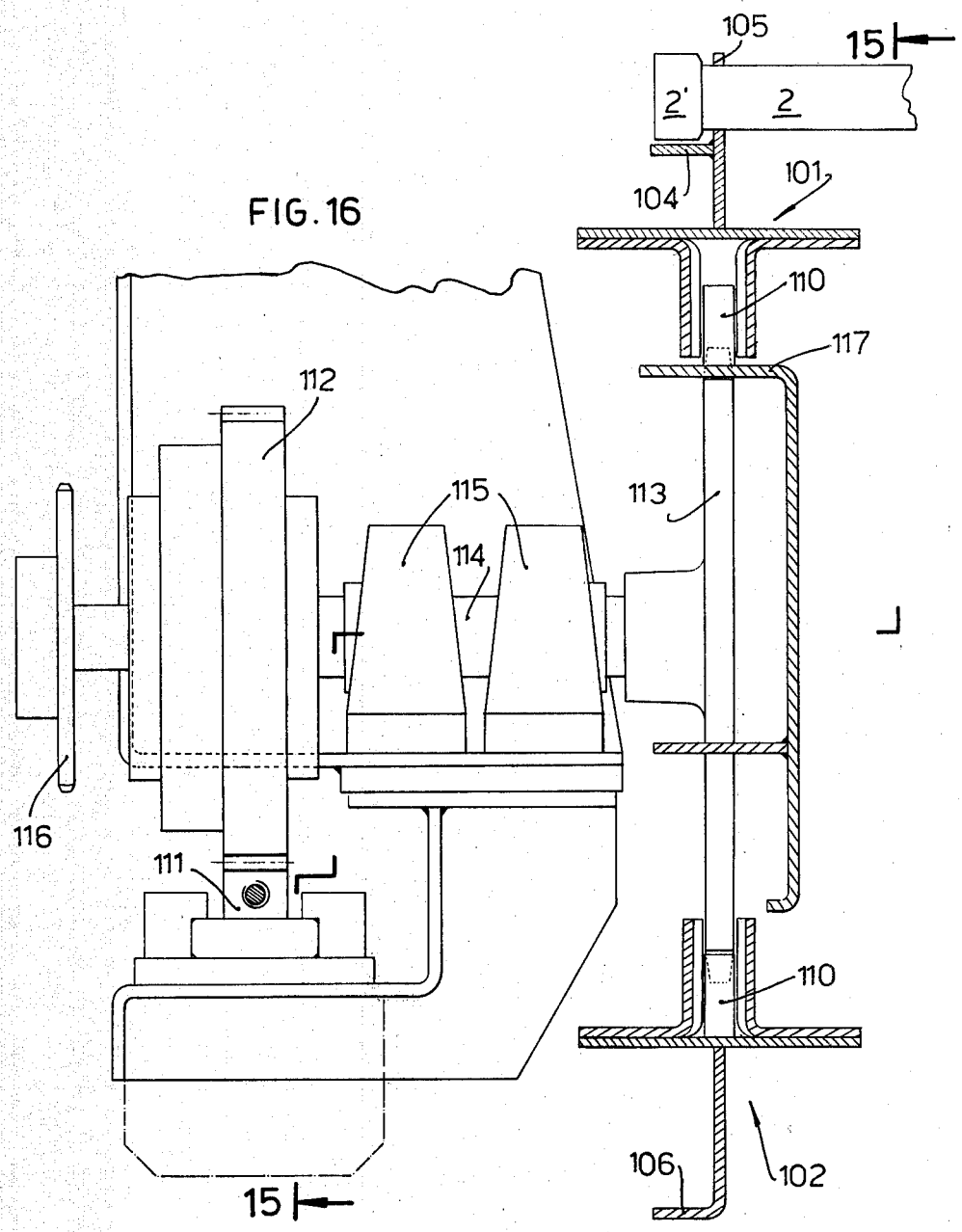
FIG. 16 is a fragmentary partly sectional view of the unloading conveyor control as seen from the left relative to FIG. 15.
Figure 17:
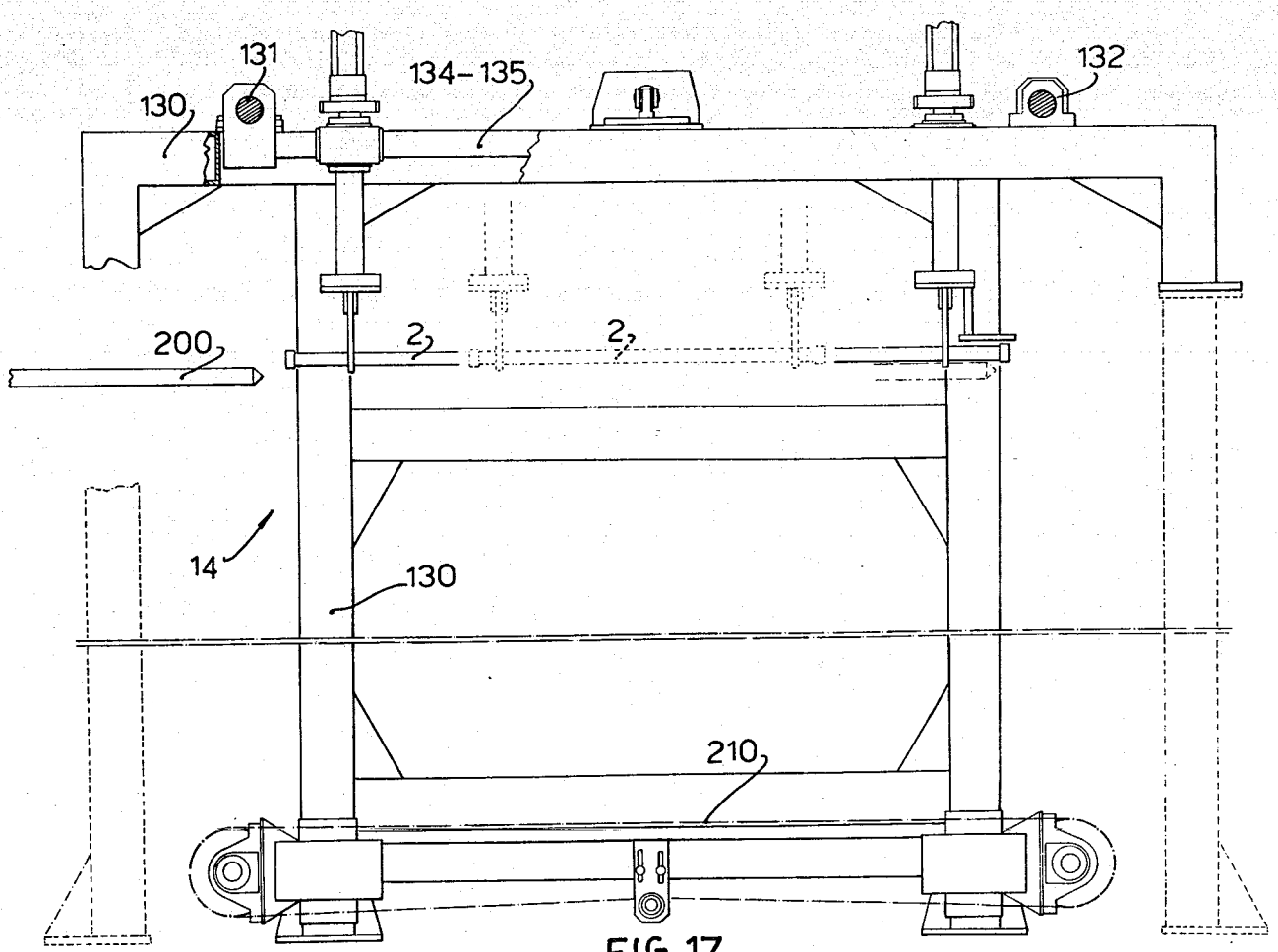
FIG. 17 is an elevational view of the hank gripping and transferring device.
Figure 18:
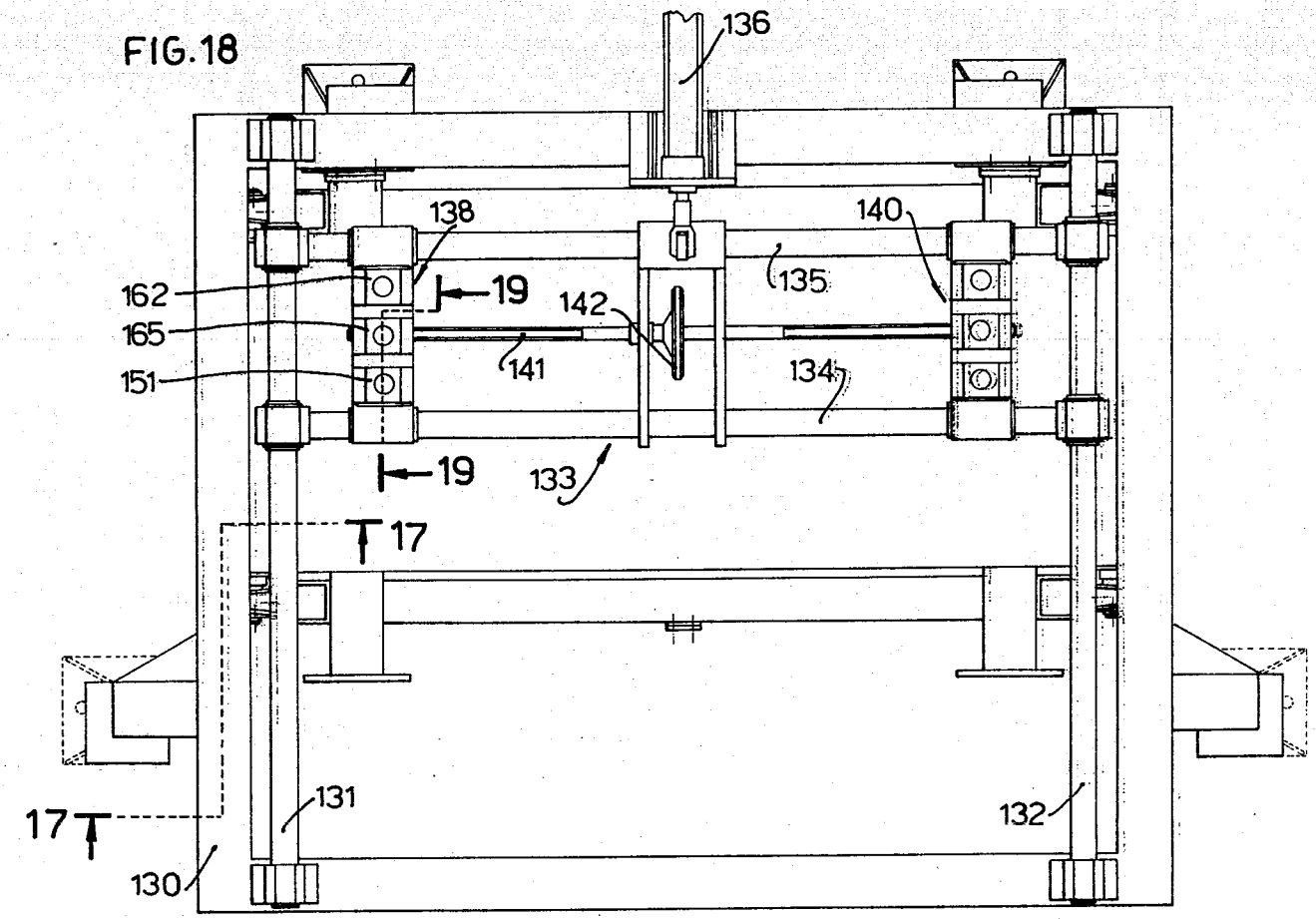
FIG. 18 is a plan view of the device shown in FIG. 17.

Chains 100 are intermittently forwardly moved by a step or pitch which is four or more times greater than the chain pitch, or equal to the distance or spacing between each first and third cavities. The forward movement is controlled in any desired manner, preferably by a system comprising a rack 111 and gear wheel 112 (FIG. 15), in which said rack is driven by a cylinder-piston unit 111' and the gear wheel is connected to the driving gear wheel 113 for the chain, preferably by means of a freewheel system. FIG. 16 shows a shaft 114 for a gear wheel 113. This shaft is supported on bearings 115 and carries the gear wheel 112 as mounted, the freewheel device and intermediate gear wheel 116 for the drive to the other chain. A bearing plane 117 for the chain is also shown in FIG. 16.

It should be noted that each time the outlet pliers of the squeezer would release on the unloading device a pair of overlapped sticks 2 with the hanks hanging down. In order to separate and move the sticks away, and since cavities are provided on the unloading chains of the unloading device for only one stick, for each chain a cam separator 120 (FIGS. 3, 13 and 14) is secured on the movable bars at fixed position, such a cam separator comprising two side plates 121 and 122 and a bottom plate 123, which plates are of lead-in configuration and adjustable in place for the setting up of the system. Such plates or cams 121, 122 and 123 retain a top stick 2, whereas the bottom stick, as received within a recess or cavity 103 of a chain element, is forward moved as the chain forward moves, until a new free recess or cavity 103 is encountered, into which the retained stick is allowed to fall down. Preferably, the above mentioned plate 122 is retained in place by a calibrated spring in order to avoid jammings should an overlapped stick remain at restrained condition.

Referring to FIGS. 17 through 20, the description is now given for a translating apparatus or transfer device, providing for translating or transferring the skeins or hanks to another conveyor apparatus, and removing the sticks.

Such a translating apparatus has been shown at 14 of FIG. 2. This apparatus comprises a supporting frame, denoted as a whole at 130, and which will not be further described as it may vary depending on the system arrangement. Said frame 130 carries two horizontal sliding guides, extending for a length on the chain unloading device and being substantially parallel thereto, such guides having been denoted by 131 and 132 in FIG. 18. A frame, denoted as a whole at 133, can slide on said guides 131 and 132, and substantially comprises two transverse sliding bars, which are denoted at 134 and 135. Two pliers holding heads 138 and 140, respectively, are movable along said sliding bars 134 and 135 for a spacing adjustment. Depending on the lengths of the hank holder sticks, the adjustment of the interspacing between said heads 138 and 140 is effected by a screw 141, the latter being controlled by a handwheel 142.

Figure 19:
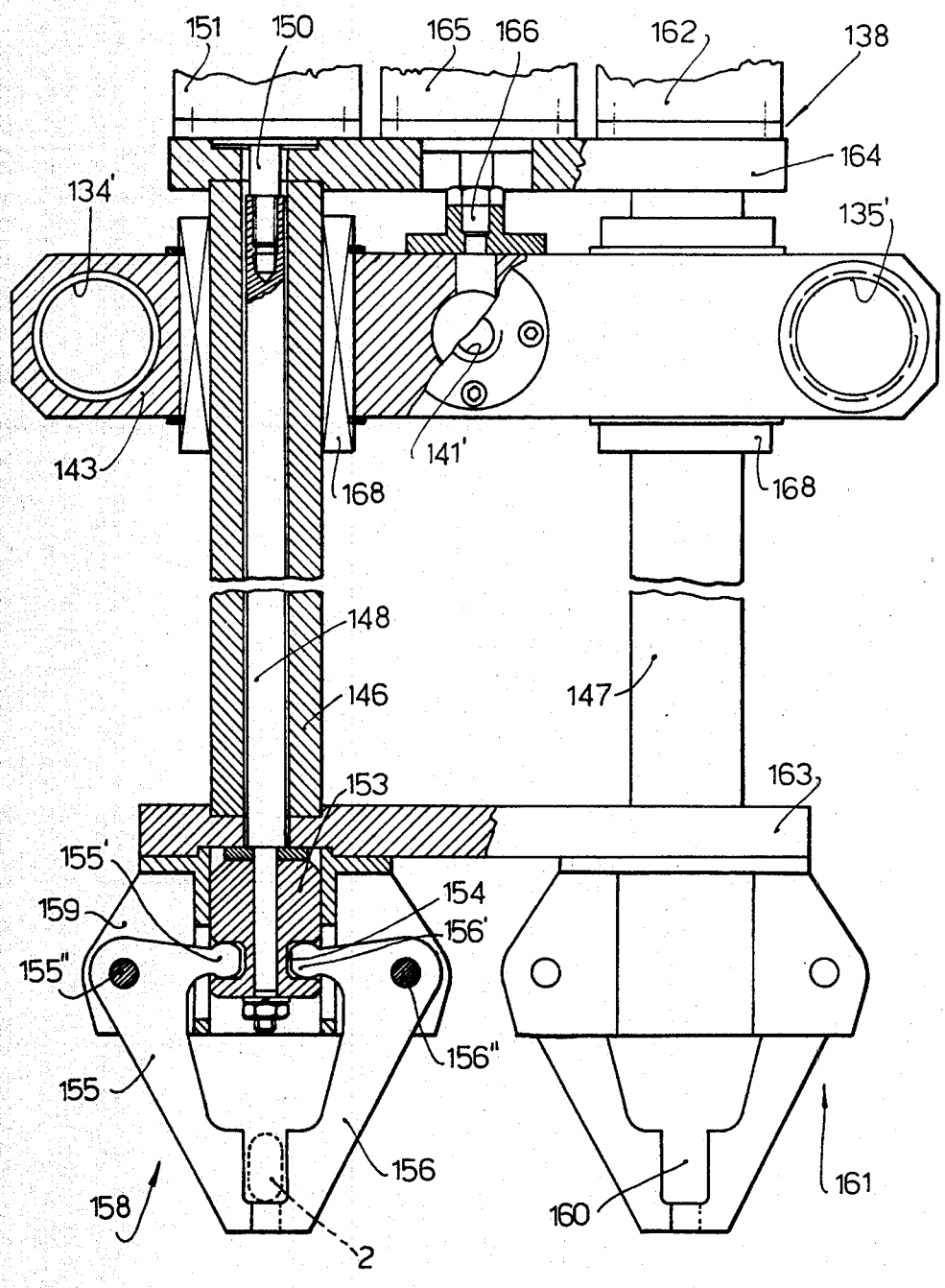
FIG. 19 is an enlarged view of a pliers holder head of the transferring device, partly cutaway according to line 19—19 of FIG. 18.

Herainafter, a more detailed description is given for one of said pliers holder heads, such as head 138, with reference to FIG. 19 of the accompanying drawings. This pliers holder head 138 comprises a block 143, at the ends of which two seats 134' and 135' are formed for sliding on bars 134 and 135, whereas a female threaded opening 141' for the adjusting screw 141 is shown centrally of the block. This block 143 carries sliding bearings 168 for two tubular or hollow elongated elements 146 and 147, respectively, each of which having sliding therein a rod connected to the piston of a cylinder-piston unit or assembly. In FIG. 19, such elements are shown for only one of the pliers, and in which the rod has been denoted at 148 and is connected to the stem 150 of a cylinder-piston unit or assembly 151. In turn, said rod 148 is at the other end connected to a slider 153, in a side cavity 154 of which the ends 155' and 156' of jaws 155 and 156 of pliers engage, the pliers being denoted as a whole at 158. Said jaws 155 and 156 are pivoted at 155" and 156", respectively, on a body 159 of the pliers and are of such a shape as to have a recess or cavity 160, when joined, for receiving a stick 2, shown by hatched outline in FIG. 19. It will be seen that the upward and downward movement of rod 148 within element 146 and accordingly the movement of slider 153 relative to said body 159 of the pliers, would enable the opening and closing of the latter. The right side pliers in FIG. 19 has been shown at 161, and will not be further described as exactly formed as pliers 158. Particularly, the cylinder-piston unit or assembly for control of pliers 161 has been indicated at 162. The lifting and lowering of the two pliers 158 and 161, made integral with each other by plates 163 and 164, occurs through a cylinder-piston unit or assembly 165, the stem 166 of which is at one end integral with said block 143, whereas the cylinder is integral with plate 164. When plate 164 raises, it drags along said hollow tubular elements 146 and 147 which slide within bearings 168. In turn, elements 146 lift plate 163 being integral therewith, with which the bodies of the pliers, such as for example 159, are integral.

The pliers 158 and 161 of head 138, which have been just described, will be for convenience hereinafter referred to as "front" pliers, which however should not be understood as a limitation to the invention. The pliers of head 140, or rear pliers, comprise the same elements as those for head 138, and additionally comprise a supporting plate rearwardly connected thereto, as shown in FIG. 20. FIG. 20 shows two "rear" pliers 170 and 171, or pliers for head 140, the respective tubular elements 172 and 173 (broken away) integral with the lower plate 174, the two bodies of the pliers shown at 176 and 177, respectively, and the jaws of the pliers shown at 178 and 180 (only the jaws at the right are shown).

Plate 174 has secured thereto the supports denoted at 182 and 183, respectively, essentially comprising a plate 182' and 183', respectively, substantially arranged over the cavity forming the jaws of the pliers for receiving the sticks 2. The position of said plates 182 and 183 is such that, when a stick 2 is received and retained between the jaws, its head 2', by colliding against the respective plate 182', 183', enables the stick to be retained at substantially horizontal position even without the aid of the other pair of pliers.

The operation of the system will now be briefly described. At the outlet from a dyeing cabinet or carriage for the wet hanks, one or more hanks carried on two sticks are caught by gripping both of the supporting sticks and moving them near one another, and are placed on a pair of aligned plates of the chain feeder 11 which, as above mentioned, moves in intermittent fashion. The movement of said chain feeder 11 is coordinated with the movement of the pliers of the squeezing unit or device 12, so that when a pair of plates of said feeder 11, as loaded with the sticks and relative hanks, arrives at a predetermined position, a suitable control enables the start of the squeezer pliers operation. The pair of inlet pliers of the squeezer, upon reaching the position shown by dashed line at the left side of FIG. 3, will open due to the action of the respective cylinder-piston units, such as the unit 72 of FIG. 10, then carriage 65 is lowered due to the action of cylinder-piston unit 64, gripping the pair of underlying overlapped sticks adjacent the ends thereof, as it will be seen for example in FIG. 7, closing again due to the action of cylinder 72 and raising due to the action of said cylinder-piston unit 64. Thus, a horizontal translation of the whole frame 60 (FIG. 10) occurs along guides 61, 61 (FIG. 9) to the position shown by full line in FIG. 3, that is to a position at which the inlet pliers are on the vertical of the cups carried by slide 90. Now, a further lowering of the pliers holding head occurs by means of cylinder 64, then the pliers open, thus placing the ends of sticks 2 within the respective cups. Still automatically by automatisms of known type or anyhow readily in the range of those skilled in the art, the cylinder-piston units 93 are then operated to lower said slides 90 to such a position that the hank(s) is (are) located at the level of rollers 85 and 86. Then cylinder 88 provides for moving roller 86 close to roller 85, as shown by dashed line in FIG. 3. As above mentioned, this latter roller 85 is driven by a freewheel device. Said cylinder-piston units 93 operate to lift at a preset rate said slides 90 with the suspended hank 1 to remove it from the squeezing rollers 86 and 85. It should be noted that the interposition of the freewheel device in the control or drive for roller 85 avoids the occurrence of the so-called blow between said rollers 86 and 85, when a hank is missing therebetween, as it would occur in the prior art devices due to the difference in peripheral speed of the two rollers. Upon completion of the squeezing operation, the roller 86 is conventionally moved away. Now and still automatically, the squeezer frame 60 is restored to the condition shown by dashed line in FIG. 3, whereby the pair of outlet pliers shown at the right side of FIG. 3 is now on the vertical of the stick carrying cups. These pliers lower at open condition and close on sticks 2, raise up again and move to the right, as seen in FIG. 3, to be on the vertical of the loading position of the above mentioned chain unloading device 13. It should be noted that, in this way and as already known, through the two pairs of the squeezer pliers, the loading of a new hank to be wringed on slide 90 and the unloading of a wringed hank therefrom are simultaneously carried out.

As long as the holding sticks are gripped by the outlet pliers of the squeezer, such sticks are still at overlapped relationship. When the outlet pliers of the squeezer open, the lower or bottom stick of the two sticks carrying the hand or group of hands is received within the cavity of a first pair of plates 101, which are thereunder, while the second stick remains at bearing condition on the former; when in the stepwise movement of the chain unloading device 13, the latter is moved to the right as seen in FIG. 3, the cam or guide devices 120 retain the upper or top stick 2 until a further pair of elements 101 provided with cavity is thereunder. Therefore, also the second hank carrying stick falls down into said cavities and the hanks are suspended between two sticks at removed condition, that is are conveyed by the unloading device at a widened or spread out condition. Obviously, the movements for the chain feeder, squeezer and unloading device are coordinated to allow said operation in any manner in the range of those skilled in the art.

The movement of the translating device 14 is also coordinated with the above mentioned movements. The spacing between the "front" pliers and "rear" pliers of the translating device is preset at the plant installation in accordance with the spacing between the plates provided with cavities of the chain unloading device. Thus, the pliers of the translating device simultaneously grip, at the respective ends, the two spaced apart sticks, the latter being lifted and conveyed parallel to themselves. Obviously, the amount of this transportation may be varied depending on the requirements of each specific system or plant. Generally, the translating device would supply the hanks on two rods, denoted at 200 of FIG. 17, of a spreadable rod transferring device, as disclosed in several copending applications of the same applicant. Such rods 200 are forward moved under the removed sticks 2 held by the pliers; and move away from one another, so as to support the hanks. Then, the front pliers (at the left side of FIG. 17) are opened and lifted, so that said rods 200 can be retracted to remove or unthread the hanks from sticks 2. At this stage, sticks 2 remain suspended, only carried by the pliers indicated as rear pliers 170 and 171 in FIG. 20. Upon removal of the hanks, these last mentioned pliers also open so that the sticks can fall down on a suitable collection device, such as a carriage or a belt denoted at 210 of FIG. 17.

Obviously, all of those changes and modifications that are within the range of those skilled in the art can be made to the foregoing, without departing thereby from the field to be covered by the present application.

I claim:

1. A plant for squeezing hank yarns, the hanks being carried on sticks, said plant comprising means for conveying the hanks carried on sticks to a squeezing unit, a squeezing unit for squeezing the hanks, and means for removing squeezed hanks from the squeezing unit, characterized in that said means for conveying comprises a chain feeder having two parallel chains formed of interconnected plates, and two parallel chain members formed with plate elements secured to the plates of said chains, each element having an outwardly open notch or cutout, such a notch or cutout being of such dimensions as to receive two overlapped approached parallel hank holding sticks.

2. A plant according to claim 1, characterized in that the parallel chains in said chain feeder are interconnected for movement and intermittently driven for a distance corresponding to the spacing between two subsequent notches or cutouts.

3. A plant according to claim 1, further comprising means for adjusting the spacing between the chains in said chain feeder in accordance with the length of said hank holding sticks.

4. A plant according to claim 3, characterized in that said means for adjusting comprises transverse sliding guides, bars slidably carried on said guides, said gear wheels and relative control or drive members mounted on said bars slidably carried on said transverse sliding guides.

5. A plant for squeezing hank yarns, said hanks being carried on sticks, said plant comprising means for conveying hanks carried on sticks to a squeezing unit, a squeezing unit for squeezing the hanks, and means for removing squeezed hanks from the squeezing unit, wherein said squeezing unit comprises pliers for gripping the sticks, the pliers having jaws thereof of such a shape as to form, when joined at closed position, a cavity for receiving two hank holding sticks at overlapped relationship to each other.

6. A plant for squeezing hank yans, said hanks being carried on sticks, said plant comprising means for conveying hanks carried on sticks to a squeezing unit, a squeezing unit for squeezing the hanks, and means for removing squeezed hanks from the squeezing unit, wherein said squeezing unit comprises a pair of inlet pliers and a pair of outlet pliers; said two pairs of pliers being movable integrally with each other in vertical and longitudinal directions relative to the plant, and heads for mounting the pliers so that the spacing between the pliers of each pair is adjustable in accordance with the stick length by moving said heads near and away from one another.

7. A plant according to claim 6, characterized in that said squeezing unit comprises squeezing rollers, and two opposite slides with supporting cups for said hank holding sticks to lower said hanks between said squeezing rollers, and characterized by comprising cups of different extensions interchangeable on said slides, and that each of said cups are suitable to receive the ends of two overlapped sticks.

8. A plant for squeezing hank yarns, the hanks being carried on sticks, said plant comprising means for conveying hanks carried on sticks to a squeezing unit, a squeezing unit for squeezing hanks, and means for removing squeezed hanks from the squeezing unit, wherein said means for removing comprises a chain unloading device having two parallel chains formed of interconnected hinged plates, and two parallel chain members formed of plate elements secured to said hinged plates of said chains for which alternately one plate element is provided with a cavity for receiving a single hank holding stick, and one or more plate elements have a flat edge, that is free of cavity.

9. A plant according to claim 8, characterized in that said chain unloading device is intermittently moved for a distance corresponding to the spacing between pairs of plate elements provided with cavities.

10. A plant according to claim 8, wherein said squeezing unit includes outlet pliers for transferring squeezed hanks to said means for removing, said means for removing having a cam separator placed at each side of the squeezing unit adjacent the position at which the outlet pliers of the squeezing unit load the chain unloading device, said cam separator cooperating with said outlet pliers to retain an upper or top stick of two overlapped hank holding sticks when the lower or bottom stick has been received within a pair of cavities of the chain, until the arrival of the next pair of successive cavities, thereby moving away from each other the sticks of a same hank to provide a widening or spreading out of said hank.

11. A plant according to claim 10, further comprising means for adjusting the spacing between the chains of said chain unloading device in accordance with the length of the hank holding sticks.

12. A plant according to claim 11, characterized in that said means for adjusting comprises transverse sliding guides, bars slidably guided on said guides, said gear wheels for said chains and relative control or drive members mounted on said bars slidably carried on said tranverse sliding guides, said cam separator being mounted on said bars.

13. A plant for squeezing hank yarns, the hanks being carried on sticks, said plant comprising a squeezing unit for squeezing hanks carried on sticks, means for receiving squeezed hanks from said squeezing unit, and a translating or transferring device for removing and for transferring hanks from said means for receiving, said translating or transferring device comprising two first or "front" pliers spaced apart from each other; two second or "rear" pliers spaced apart from each other and from the first pliers and aligned therewith, the pliers having jaws forming cavities each for receiving only one hank holding stick; and guides for guiding movement of said pliers, the front and rear pliers being integrally movable along said guides.

14. A plant according to claim 13, characterized in that the "front" pliers are openable separately from the "rear" pliers.

15. A plant according to claim 13, characterized in that said rear pliers are provided with a top bearing or support having the stick heads bearing thereon when carried only by the rear pliers.

16. A plant according to claim 13, characterized by the provision of heads for mounting the pliers for providing a spacing adjustment between the front pliers and the rear pliers in accordance with the dimensions of the hank holding sticks, sliding bars for guiding movement of said heads near and away from one another, said sliding bars being movable along said guides.

17. A plant for moving yarn hanks along a path through a squeezing unit, said hanks, when entering said plant, being extended between two sticks inserted therein, comprising:

means for bringing the sticks to be adjacent to each other;

means for moving both the adjacent sticks with the suspended hanks through the squeezing unit;

means for spreading the sticks upon leaving the squeezing unit for widening out the hanks; and means for withdrawing the hanks from the spread sticks, while removing at the same time said sticks.

18. A plant for moving yarn hanks along a path through a treating unit, said hanks, when entering said plant, being extended between two sticks inserted therein, comprising:

means for bringing the sticks to be adjacent to each other;

means for moving both the adjacent sticks with the suspended hanks through the treating unit;

means for spreading the sticks upon leaving the treating unit for widening out the hanks; and means for withdrawing the hanks from the spread sticks, while removing at the same time said sticks.

* * * * *

UNITED STATES PATENT AND TRADEMARK OFFICE

CERTIFICATE OF CORRECTION

PATENT NO. : 4,374,471

DATED : Feb. 22, 1983

INVENTOR(S) : Frederico MINNETTI

It is certified that error appears in the above-identified patent and that said Letters Patent are hereby corrected as shown below:

On the title page, before line "[51]" insert:

[30] Foreign Application Priority Data

Sept. 28, 1979 Italy ..... 26127 A/79

Signed and Sealed this

Third Day of May 1983

[SEAL]

*Attest:*

GERALD J. MOSSINGHOFF

*Attesting Officer* *Commissioner of Patents and Trademarks*